US007636452B2

(12) United States Patent
Kamon

(10) Patent No.: US 7,636,452 B2
(45) Date of Patent: Dec. 22, 2009

(54) SYSTEM AND METHOD FOR AUTOMATICALLY ACQUIRING A TARGET WITH A NARROW FIELD-OF-VIEW GIMBALED IMAGING SENSOR

(75) Inventor: Ishay Kamon, Misgav (IL)

(73) Assignee: Rafael Advanced Defense Systems Ltd., Haifa (IL)

( * ) Notice: Subject to any disclaimer, the term of this patent is extended or adjusted under 35 U.S.C. 154(b) by 403 days.

(21) Appl. No.: 11/086,466

(22) Filed: Mar. 23, 2005

(65) Prior Publication Data

US 2005/0218259 A1 Oct. 6, 2005

(30) Foreign Application Priority Data

Mar. 25, 2004 (IL) ..... 161082

(51) Int. Cl.

| | |
|---|---|
| ***G06K 9/32*** | (2006.01) |
| ***H04N 7/18*** | (2006.01) |
| ***H04N 5/232*** | (2006.01) |
| ***B64D 7/00*** | (2006.01) |
| ***F41G 5/06*** | (2006.01) |
| ***G06F 19/00*** | (2006.01) |
| ***G06G 7/80*** | (2006.01) |

(52) U.S. Cl. ..... 382/103; 382/294; 348/153; 348/208.14; 89/36.11; 89/41.05; 235/411

(58) Field of Classification Search ..... 382/103, 382/106, 294, 295; 348/153, 208.14, 208.15, 348/152, 159; 89/41.05, 36.11; 235/405, 235/409, 410, 411

See application file for complete search history.

(56) References Cited

U.S. PATENT DOCUMENTS 2,930,894 A * 3/1960 Bozeman ..... 250/203.6

(Continued)

FOREIGN PATENT DOCUMENTS

EP 0111192 6/1984

(Continued)

OTHER PUBLICATIONS

The Authoritative Dictionary of IEEE Standards Terms, 2000, IEEE, Seventh Edition, p. 532.*

(Continued)

*Primary Examiner*—Brian P Werner
*Assistant Examiner*—Anthony Mackowey
(74) *Attorney, Agent, or Firm*—Mark M. Friedman

(57) ABSTRACT

A system for automatically acquiring a target with a narrow field-of-view gimbaled imaging sensor. The system includes a target-detection subsystem including one or more target-detection imaging sensor with a first field-of-view, a target-tracking subsystem and a processing system in communication with the target-detection subsystem and the target-tracking imaging subsystem. The target-tracking subsystem includes a target-tracking imaging sensor with a second field-of-view smaller than the first field-of-view, and a gimbal mechanism for controlling a viewing direction of the target-tracking imaging sensor. The processing system includes a target transfer module responsive to detection of a target by the target-detection subsystem to process data from the target-detection subsystem to determine a target direction vector, operate the gimbal mechanism so as to align the viewing direction of the target-tracking imaging sensor with the target direction vector, derive an image from the target-tracking imaging sensor, correlate the image with one or more part of an image from the target-detection subsystem to derive a misalignment error, and supply the misalignment error to the target-tracking subsystem for use in acquisition of the target.

12 Claims, 2 Drawing Sheets

U.S. PATENT DOCUMENTS

| | | | | | |
|---|---|---|---|---|---|
| 2,968,997 | A | | 1/1961 | Newton et al. | |
| 3,986,682 | A | * | 10/1976 | Dryden | 244/3.17 |
| 4,274,609 | A | * | 6/1981 | Ferrier et al. | 244/3.14 |
| 4,579,035 | A | * | 4/1986 | Whiting | 89/41.05 |
| 4,598,884 | A | * | 7/1986 | Speer | 244/3.16 |
| 4,622,554 | A | | 11/1986 | Gellekink et al. | |
| 4,922,801 | A | * | 5/1990 | Jaquard et al. | 89/41.05 |
| 5,123,327 | A | * | 6/1992 | Alston et al. | 89/1.813 |
| 5,164,827 | A | * | 11/1992 | Paff | 348/143 |
| 5,208,418 | A | * | 5/1993 | Toth et al. | 89/41.07 |
| 5,229,540 | A | * | 7/1993 | Schabdach et al. | 89/41.03 |
| 5,345,304 | A | * | 9/1994 | Allen | 356/5.01 |
| 5,379,676 | A | * | 1/1995 | Profeta et al. | 89/41.05 |
| 5,418,364 | A | * | 5/1995 | Hale et al. | 250/334 |
| 5,434,617 | A | * | 7/1995 | Bianchi | 348/170 |
| 5,596,509 | A | * | 1/1997 | Karr | 235/411 |
| 5,773,745 | A | | 6/1998 | Widmer | |
| 5,918,305 | A | * | 6/1999 | Livingston | 89/1.11 |
| 5,936,229 | A | * | 8/1999 | Livingston | 250/203.2 |
| 5,964,432 | A | * | 10/1999 | Obkircher | 244/3.16 |
| 6,215,519 | B1 | * | 4/2001 | Nayar et al. | 348/159 |
| 6,324,955 | B1 | | 12/2001 | Andersson | |
| 6,393,136 | B1 | * | 5/2002 | Amir et al. | 382/103 |
| 6,429,446 | B1 | | 8/2002 | Labaugh | |
| 6,480,140 | B1 | | 11/2002 | Rosefsky | |
| 6,587,486 | B1 | | 7/2003 | Sepp | |
| 6,690,374 | B2 | * | 2/2004 | Park et al. | 345/427 |
| 6,724,421 | B1 | * | 4/2004 | Glatt | 348/154 |
| 6,741,341 | B2 | * | 5/2004 | DeFlumere | 356/141.1 |
| 6,836,320 | B2 | * | 12/2004 | Deflumere et al. | 356/141.1 |
| 6,847,392 | B1 | * | 1/2005 | House | 348/36 |
| 6,864,965 | B2 | * | 3/2005 | DeFlumere | 356/4.01 |
| 6,970,576 | B1 | * | 11/2005 | Tilsley | 382/103 |
| 7,006,950 | B1 | * | 2/2006 | Greiffenhagen et al. | 703/2 |
| 7,027,083 | B2 | * | 4/2006 | Kanade et al. | 348/159 |
| 7,129,981 | B2 | * | 10/2006 | Berstis | 348/333.12 |
| 7,177,447 | B2 | * | 2/2007 | Olson et al. | 382/103 |
| 7,301,557 | B2 | * | 11/2007 | Kakou et al. | 348/36 |
| 7,463,753 | B2 | * | 12/2008 | Williams et al. | 382/103 |
| 7,536,028 | B2 | * | 5/2009 | Sumitomo | 382/103 |
| 7,542,588 | B2 | * | 6/2009 | Ekin et al. | 382/103 |
| 7,551,121 | B1 | * | 6/2009 | O'Connell et al. | 342/54 |
| 2002/0005902 | A1 | * | 1/2002 | Yuen | 348/211 |
| 2003/0026588 | A1 | | 2/2003 | Elder et al. | |
| 2003/0142005 | A1 | * | 7/2003 | Bar-Avi et al. | 342/52 |
| 2004/0021852 | A1 | * | 2/2004 | DeFlumere | 356/141.1 |
| 2005/0063566 | A1 | * | 3/2005 | Beek et al. | 382/115 |
| 2005/0065668 | A1 | * | 3/2005 | Sanghera et al. | 701/3 |
| 2005/0134685 | A1 | * | 6/2005 | Egnal et al. | 348/157 |
| 2006/0056056 | A1 | * | 3/2006 | Ahiska et al. | 359/690 |
| 2006/0163446 | A1 | * | 7/2006 | Guyer et al. | 250/203.1 |
| 2006/0203090 | A1 | * | 9/2006 | Wang et al. | 348/143 |

FOREIGN PATENT DOCUMENTS

| | | |
|---|---|---|
| WO | WO88/08952 | 11/1988 |

OTHER PUBLICATIONS

Elder Laboratory "Attentive Sensor Tracing Video 2(1.5 Mb, MPEG, Canada)"; "camera Tracing Video (2.2 Mb, MPEG, Canada)" Uploaded Sep. 24, 2004 Downloadable : http://www.elderlab.yorku.ca/?page=projectA3&sbCAM/.

"Image Registration for Omnidirectional Sensors": Proc. 7$^{th}$ European Conference on Computer Vision, Copenhagen, in Lecture Notes in Computer Science, vol. 2353, Springer-Verlag, Berlin, 606-620; authors: unknown Published: 2002.

"Red-Sky 2 Short Range Air Defense System"; Israel Aircraft industries Ltd. Feb. 2004. Down loadable : http://www.defense-update.com/products/r/red-sky.htm.

"Raven Eye II (RE-II), Unmanned Multi-Mission Stabilized Payload"; authors: Northrup Grumman, Mar. 1, 2004, Downloadable: http://peoiewswebinfo.monmouth.army.mil/portal_sites/IEWS_Public/rus/.

* cited by examiner

SYSTEM AND METHOD FOR AUTOMATICALLY ACQUIRING A TARGET WITH A NARROW FIELD-OF-VIEW GIMBALED IMAGING SENSOR

FIELD AND BACKGROUND OF THE INVENTION

The present invention relates to target tracking and, in particular, it concerns a system and method for automatically acquiring a target with a narrow field-of-view gimbaled imaging sensor.

In warfare, there is a need for defensive systems to identify incoming threats and to automatically, or semi-automatically, operate appropriate countermeasures against those threats. Recently, in view of ever increasing levels of terrorist activity, there has also developed a need for automated missile defense systems suitable for deployment on civilian aircraft which will operate anti-missile countermeasures automatically when needed.

A wide range of anti-missile countermeasures have been developed which are effective against various different types of incoming threat. Examples of countermeasures include radar chaff and hot flare decoy dispenser systems, infrared countermeasure systems, and anti-missile projectile systems. Examples in the patent literature include: U.S. Pat. No. 6,480,140 to Rosefsky which teaches radar signature spoofing countermeasures; U.S. Pat. No. 6,429,446 to Labaugh and U.S. Pat. No. 6,587,486 to Sepp et al. which teach IR laser jamming countermeasures; U.S. Pat. No. 5,773,745 to Widmer which teaches chaff-based countermeasures; and U.S. Pat. No. 6,324,955 to Andersson et al. which teaches an explosive countermeasure device.

Of most relevance to the present invention are directional countermeasures, such as Directional IR Countermeasures (DIRCM), which must be directed accurately towards an incoming threat. For this purpose, such systems typically use a target-tracking subsystem with a narrow field-of-view ("FOV") imaging sensor to track the incoming target. Typically, this may be a FLIR with an angular FOV of less than 10°.

In order to reliably detect incoming threats, automated countermeasure systems need to have a near-panoramic target-detection subsystem covering a horizontal FOV of at least 180°, and more preferably 270° or even 360°. Similarly, a large vertical FOV is also required, preferably ranging from directly below the aircraft up to or beyond the horizontal. For this purpose, a number of scanning or staring sensors are preferably combined to provide continuous, or pseudo-continuous, monitoring of the effective FOV.

In operation, the target-detection subsystem identifies an incoming target and, based upon the pixel position on the target-detection sensor which picks up the target, determines a target direction vector. A gimbal mechanism associated with the target-tracking sensor is then actuated to align the target-tracking sensor towards the target for tracking, target verification and/or countermeasure deployment.

In practice, the hand-off between the target-detection subsystem and the target-tracking subsystem is often unreliable. Specifically, the very large FOV of the target-detection sensors necessarily requires that the angular resolution of each target-detection sensor is very much lower than that of the target-tracking sensor. The physical limitations imposed by the low resolution detection data are often exacerbated by imprecision in mounting of the subsystems, flexing of the underlying aircraft structure during flight, and other mechanical and timing errors. The overall result is that the alignment error of the target-tracking subsystem relative to the target detected by the target-detection subsystem may interfere with reliable acquisition of the target, possibly preventing effective deployment of the countermeasures.

There is therefore a need for a system and method for automatically acquiring a target with a narrow field-of-view gimbaled imaging sensor which would achieve enhanced reliability of hand-off from the target-detection subsystem.

SUMMARY OF THE INVENTION

The present invention is a system and method for automatically acquiring a target with a narrow field-of-view gimbaled imaging sensor.

According to the teachings of the present invention there is provided, a system for automatically acquiring a target with a narrow field-of-view gimbaled imaging sensor, the system comprising: (a) a target-detection subsystem including at least one target-detection imaging sensor having a first field-of-view; (b) a target-tracking subsystem including: (i) a target-tracking imaging sensor having a second field-of-view significantly smaller than the first field-of-view, and (ii) a gimbal mechanism for controlling a viewing direction of the target-tracking imaging sensor; and (c) a processing system in communication with the target-detection subsystem and the target-tracking imaging subsystem, the processing system including a target transfer module responsive to detection of a target by the target-detection subsystem to: (i) process data from the target-detection subsystem to determine a target direction vector, (ii) operate the gimbal mechanism so as to align the viewing direction of the target-tracking imaging sensor with the target direction vector, (iii) derive an image from the target-tracking imaging sensor, (iv) correlate the image with at least part of an image from the target-detection subsystem to derive a misalignment error, and (v) supply the misalignment error to the target-tracking subsystem for use in acquisition of the target.

According to a further feature of the present invention, there is also provided at least one missile countermeasure subsystem associated with the target-tracking subsystem.

According to a further feature of the present invention, the target-detection subsystem includes a plurality of the target-detection imaging sensors deployed in fixed relation to provide an effective field-of-view significantly greater than the first field of view.

According to a further feature of the present invention, corresponding regions of the images from the target-tracking imaging sensor and from the target-detection imaging sensor have angular pixel resolutions differing by a factor of at least 2:1.

According to a further feature of the present invention, the target transfer module is configured to correlate the image from the target-tracking imaging sensor with an image sampled from the target-detection imaging sensor at a time substantially contemporaneous with sampling of the image from the target-tracking imaging sensor.

According to a further feature of the present invention, the target-tracking subsystem is configured to be responsive to the misalignment error to operate the gimbal mechanism so as to correct alignment of the viewing direction of the target-tracking imaging sensor with the target.

There is also provided according to the teachings of the present invention, a method for automatically acquiring a target by using a system with a target-detection subsystem including at least one target-detection imaging sensor having a first field-of-view and a target-tracking subsystem including an imaging sensor having a second field-of-view significantly smaller than the first field-of-view, the method comprising: (a) employing the target-detection subsystem to detect a target; (b) determining from the target-detection subsystem a target direction vector; (c) operating a gimbal mechanism of the target-tracking subsystem so as to align a viewing direction of the target-tracking imaging sensor with the target direction vector; (d) deriving an image from the target-tracking imaging sensor; (e) correlating the image with at least part of an image from the target-detection subsystem to derive a misalignment error; and (f) supplying the misalignment error to the target-tracking subsystem for use in acquisition of the target.

According to a further feature of the present invention, a missile countermeasure subsystem associated with the target-tracking subsystem is operated.

According to a further feature of the present invention, the target-detection subsystem includes a plurality of the target-detection imaging sensors deployed in fixed relation to provide an effective field-of-view significantly greater than the first field of view.

According to a further feature of the present invention, corresponding regions of the images from the target-tracking imaging sensor and from the target-detection imaging sensor have angular pixel resolutions differing by a factor of at least 2:1.

According to a further feature of the present invention, the correlating is performed using an image sampled from the target-detection imaging sensor at a time substantially contemporaneous with sampling of the image from the target-tracking imaging sensor.

According to a further feature of the present invention, alignment of the viewing direction of the target-tracking imaging sensor is corrected as a function of the misalignment error.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is a system and method for automatically acquiring a target with a narrow field-of-view gimbaled imaging sensor.

The principles and operation of systems and methods according to the present invention may be better understood with reference to the drawings and the accompanying description.

Figure 1:
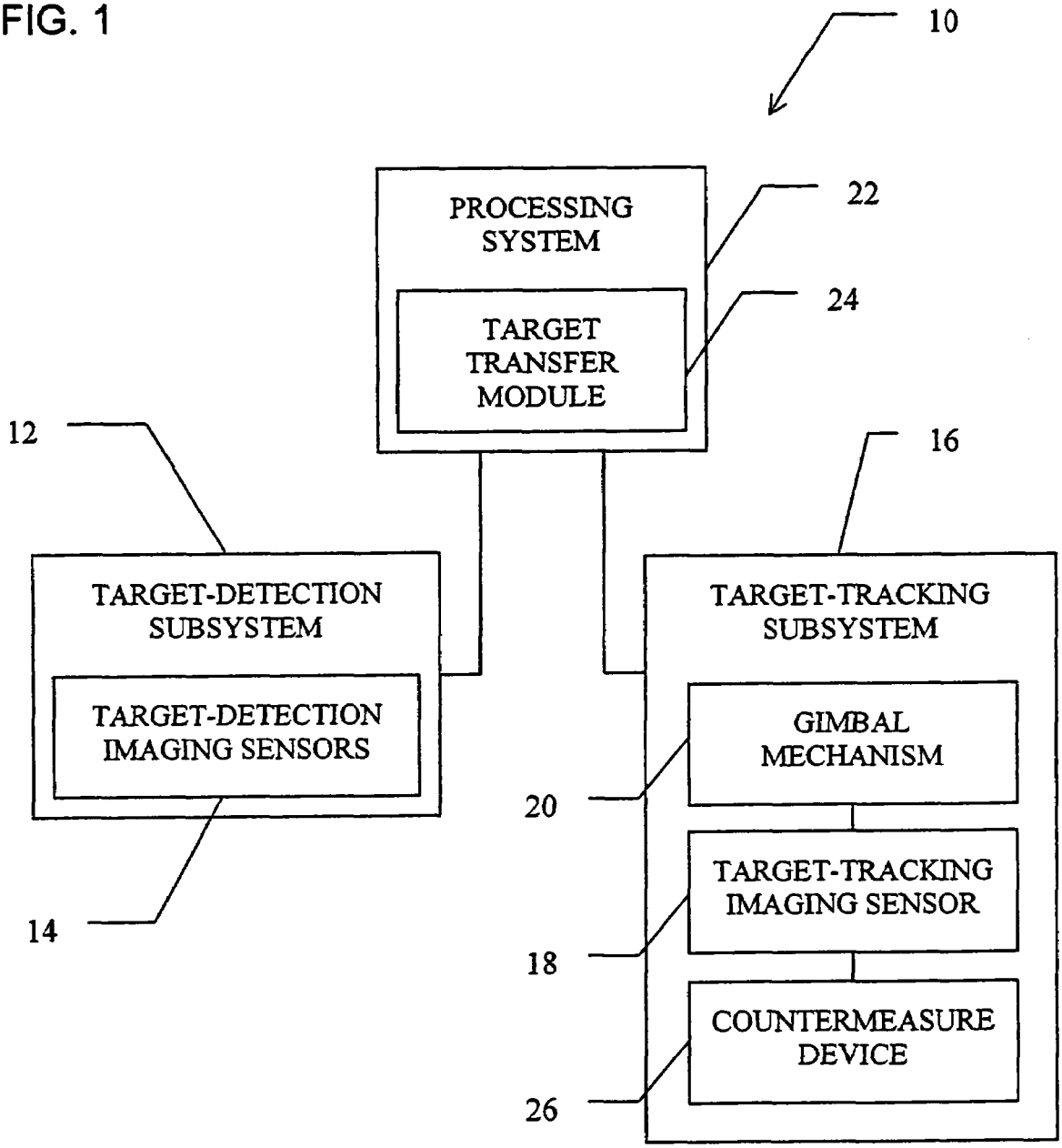
FIG. 1 is a block diagram of a system, constructed and operative according to the teachings of the present invention, for automatically acquiring a target with a narrow field-of-view gimbaled imaging sensor.

Referring now to the drawings, FIG. 1 shows a system 10, constructed and operative according to the teachings of the present invention, for automatically acquiring a target with a narrow field-of-view gimbaled imaging sensor. Generally speaking, system 10 has a target-detection subsystem 12 including at least one target-detection imaging sensor 14 having a first field-of-view. System 10 also includes a target-tracking subsystem 16 including an imaging sensor 18 having a second field-of-view significantly smaller than the first field-of-view, and a gimbal mechanism 20 for controlling a viewing direction of target-tracking sensor 18. A processing system 22, in communication with target-detection subsystem 12 and target-tracking subsystem 16, includes a target transfer module 24.

Figure 2:
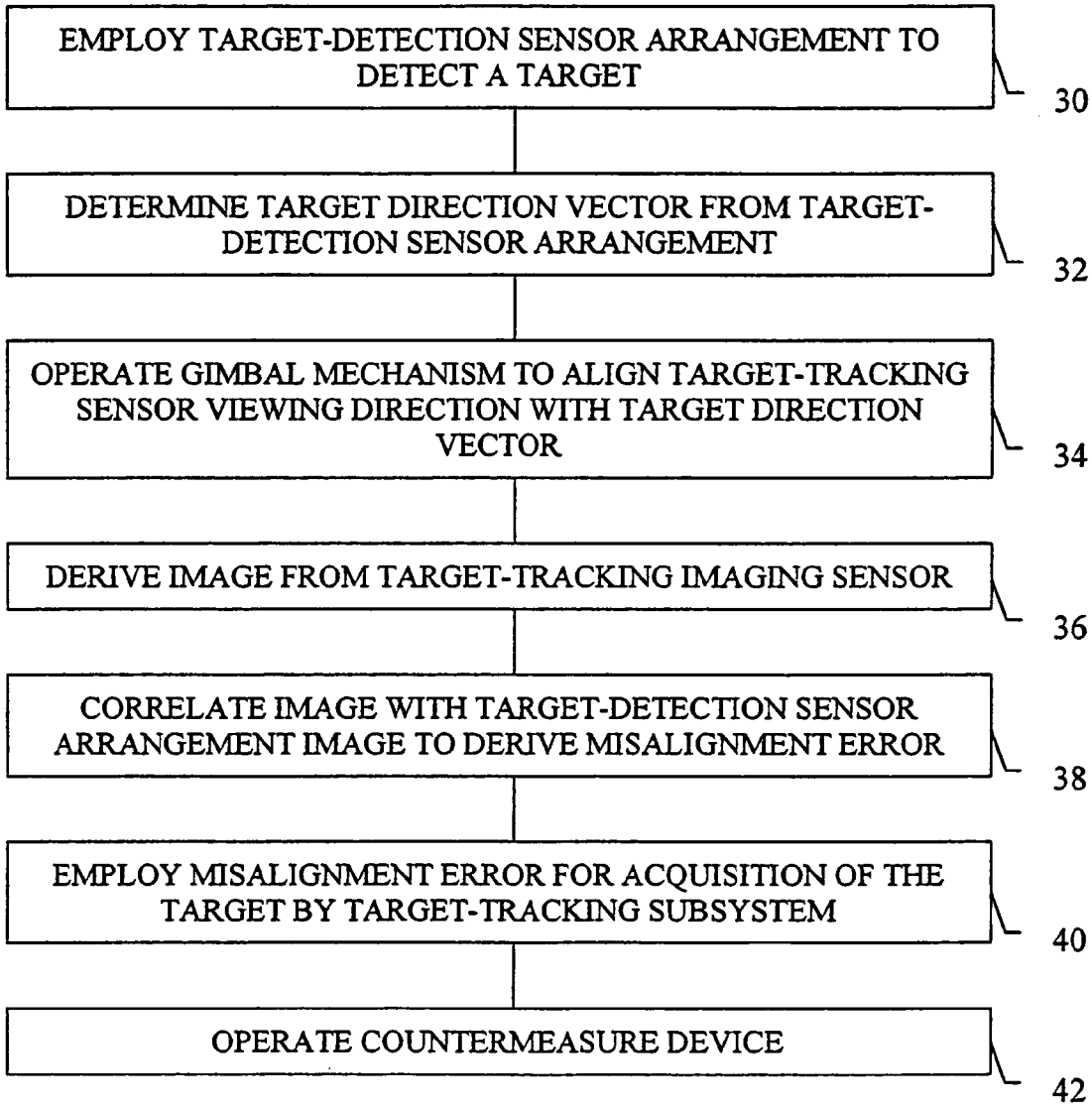
FIG. 2 is a flow diagram illustrating the operation of the system of FIG. 1 and the corresponding method of the present invention.

The operation of system 10 and the corresponding steps of a preferred implementation of the method of the present invention are shown in FIG. 2. Thus, the method begins when the system detects a target by use of target-detection subsystem 12 (step 30). Target transfer module 24 then processes data from target-detection subsystem 12 to determine a target direction vector (step 32) and operates gimbal mechanism 20 so as to align the viewing direction of target-tracking sensor 18 with the target direction vector (step 34). As mentioned earlier, the precision of such a geometrically derived hand-off between the two sensor systems is often not sufficient alone to ensure reliable acquisition of the target by target-tracking subsystem 16. Accordingly, it is a particular feature of the present invention that steps 30, 32 and 34 are supplemented with an image-processing based correction process.

Specifically, at step 36, target transfer module 24 derives an image from target-tracking imaging sensor 18 and, at step 38, correlates the image with at least part of an image from the target-detection subsystem 12 to derive a misalignment error. Target transfer module 24 then transfers the misalignment error to target-tracking subsystem 16 where it is used to facilitate acquisition of the target (step 40), thereby ensuring reliable hand-off between target-detection subsystem 12 and target-tracking subsystem 16.

It will be immediately appreciated that the present invention provides a particularly elegant and effective enhancement to the reliability of an automated target acquisition system of the type described. Specifically, the system makes use of the already present imaging sensors of the detection and tracking subsystems to provide image-processing-based self-correction of initial tracking misalignment, even where mechanical accuracy would otherwise be insufficient to ensure effective target acquisition. This and other advantages of the present invention will become clearer from the following detailed description.

Turning now to the features of the present invention in more detail, it will be noted that both target-detection subsystem 12 and target-tracking subsystem 16 are generally conventional systems of types commercially available for these and other functions. Suitable examples include, but are not limited to, the corresponding components of the PAWS-2 passive electro-optical missile warning system commercially available from Elisra Electronic Systems Ltd., Israel. Typically, the target-detection subsystem employs a plurality of staring FLIRs to cover the required near-panoramic FOV with an angular pixel resolution of between about 0.2° and about 0.5°. The target-detection subsystem also typically includes a number of additional components (not shown) as is generally known in the art. Functions of these components typically include: supporting operation of the sensor array, correcting for geometrical and sensitivity distortions inherent to the sensor arrangement, detecting targets; initial target filtering and false-target rejections; and providing data and/or image outputs relating to the target direction. All of these features are either well known or within the capabilities of one ordinarily skilled in the art, and will not be addressed here in detail.

Similarly, the features of target-tracking subsystem 16 are generally similar to those of the corresponding components of the aforementioned Elisra system and other similar commercially available systems. Typically, the target-tracking imaging sensor 18 has a field-of-view significantly smaller, and resolution significantly higher, than that of each target-detection imaging sensor 14. Specifically, sensor 18 typically has a total FOV which is less than 10% of the solid angle of the FOV for each sensor 14. Most preferably, the narrow FOV is less than 3%, and most preferably less than 2%, of the solid angle of the detection sensors 14, corresponding to an angular FOV ratio of at least 7:1. Similarly, the angular resolutions of the two types of sensors differ greatly, with a factor of at least 2:1, preferably at least 5:1, and more preferably at least 10:1. Thus, in preferred examples, the detection sensors 14 have a pixel resolution of 2-3 per degree while the tracking sensor 18 is typically in the range of 30-60 pixels per degree.

Gimbal mechanism 20 is also typically a commercially available mechanism. In the case of an automated or semi-automated countermeasure system, a suitable countermeasure device 26 is generally associated with target-tracking subsystem 16. The details of the configuration for each particular type of countermeasure device 26 vary, as will be understood by one ordinarily skilled in the art. In a preferred case of DIRCM, the countermeasure device 26 may advantageously be mounted on gimbal mechanism 20 so as to be mechanically linked ("boresighted") to move with sensor 18.

Turning now to processing system 22, this is typically a system controller processing system which controls and coordinates all aspects of operation of the various subsystems. Target transfer module 24 itself may be implemented as a software module run on a non-dedicated processing system, as a dedicated hardware module, or as a hardware-software combination known as "firmware".

It should be noted that the subdivision of components illustrated herein between target-detections subsystem 12, target-tracking subsystem 16 and processing system 22 is somewhat arbitrary and may be varied considerably without departing from the scope of the present invention as defined in the appended claims. Specifically, it is possible that one or both of the subsystems 12 and 16 may be integrated with processing system 22 such that the processing system also forms an integral part of the corresponding subsystem(s).

Turning now to the method steps of FIG. 2 in more detail, steps 30, 32 and 34 are generally similar to the operation of the Elisra PAWS-2 system mentioned above. These steps will not be described here in detail.

The image from target-tracking sensor 18 acquired at step 36 is preferably a full frame image from the sensor, and is preprocessed to correct camera-induced distortions (geometrical and intensity) as is known in the art. Preferably, the system samples a corresponding image from target-detection sensor 14 at a time as close as possible to the sampling time of the image from sensor 18. Thus, if initial alignment of gimbal mechanism 20 takes half a second from the time of initial target detection, the image registration processing of step 38 is preferably performed on an image from sensor 14 sampled at a corresponding time half a second after the initial target detection. The image frame from sensor 14 is typically not a full sensor frame but rather is chosen to correspond to the expected FOV of sensor 18 with a surrounding margin to ensure good overlap. Preferably, the width of the surrounding margin corresponds to between 50% and 100% of the corresponding dimension of the FOV of sensor 18, corresponding to a FOV of 4 to 9 times greater than the FOV of sensor 18 itself. In certain cases, depending upon the structure of target-detection subsystem 12 and the position of the target, the comparison image for step 38 may be a mosaic or compound image derived from more than one target-detection sensor 14. Here too, preprocessing is performed to correct for sensor-induced distortions.

As mentioned earlier, the images processed at step 38 have widely differing angular resolutions. Processing techniques for image registration between images of widely differing resolutions are well known in the art. It will be appreciated that the image registration is performed primarily by correlation of the background features of both images, since the target itself is typically small in both images. This allows registration of the images even in a case where severe misalignment puts the target outside the FOV of sensor 18.

The misalignment error generated by step 38 may be expressed in any format which can be used by target-tracking subsystem 16 to facilitate target acquisition. According to one preferred option, the misalignment error may be expressed as a pixel position, or a pixel-displacement vector, indicative of the current target position within, or relative to, the current FOV of sensor 18. This pixel position is then used directly by target-tracking subsystem as an input to target acquisition processing algorithms in step 40. It will be noted that the pixel position may be a "virtual pixel position" lying outside the physical sensor array, indicating that a change of viewing direction is required to bring the target into the FOV.

Alternatively, the misalignment error can be expressed in the form of an angular boresight correction which would bring the optical axis of sensor 18 into alignment with the target. Even in this case it should be noted that, where the target already lies within the FOV of sensor 18, the misalignment error may be used by target-tracking subsystem 16 to facilitate target acquisition without necessarily realigning the sensor to center the target in the field of view. Immediately subsequent to target acquisition, gimbal mechanism 20 is operated normally as part of the tracking algorithms of subsystem 16 to maintain tracking of the target.

As mentioned earlier, in the preferred case of a countermeasures system, the system preferably includes a countermeasure device 26, such as a DIRCM device as is known in the art. Countermeasure device 26 is preferably operated automatically at step 42 to destroy or disrupt operation of the incoming threat.

Although it has been described herein in the context of an automated countermeasures system for an airborne platform, it should be noted that the present invention is also applicable to a range of other applications. Examples include, but are not limited to: surface-based countermeasures systems for destroying or disrupting incoming missiles or aircraft; and automated or semi-automated fire systems for operating weapon systems from a manned or unmanned aerial, land-based or sea-based platform.

It will be appreciated that the above descriptions are intended only to serve as examples, and that many other embodiments are possible within the scope of the present invention as defined in the appended claims.

What is claimed is:

1. A system for automatically acquiring a target with a narrow field-of-view gimbaled imaging sensor, the system comprising:

(a) a target-detection subsystem including at least one target-detection imaging sensor having a first field-of-view;

(b) a target-tracking subsystem including:

(i) a target-tracking imaging sensor having a second field-of-view significantly smaller than said first field-of-view, and (ii) a gimbal mechanism for controlling a viewing direction of said target-tracking imaging sensor; and (c) a processing system in communication with said target-detection subsystem and said target-tracking imaging subsystem, said processing system including a target transfer module responsive to detection of a target by said target-detection subsystem to:

(i) process data from said target-detection subsystem to determine a target direction vector, (ii) operate said gimbal mechanism so as to align the viewing direction of said target-tracking imaging sensor with said target direction vector, (iii) derive an image from said target-tracking imaging sensor, (iv) correlate said image with at least part of an image from said target-detection subsystem by correlating features of said images to achieve image registration, thereby deriving a misalignment error, said correlating being based at least in part on background features not corresponding to the target, and (v) supply said misalignment error to said target-tracking subsystem for use in acquisition of the target.

2. The system of claim 1, further comprising at least one missile countermeasure subsystem associated with said target-tracking subsystem.

3. The system of claim 1, wherein said target-detection subsystem includes a plurality of said target-detection imaging sensors deployed in fixed relation to provide an effective field-of-view significantly greater than said first field of view.

4. The system of claim 1, wherein corresponding regions of said images from said target-tracking imaging sensor and from said target-detection imaging sensor have angular pixel resolutions differing by a factor of at least 2:1.

5. The system of claim 1, wherein said target transfer module is configured to correlate said image from said target-tracking imaging sensor with an image sampled from said target-detection imaging sensor at a time substantially contemporaneous with sampling of said image from said target-tracking imaging sensor.

6. The system of claim 1, wherein said target-tracking subsystem is configured to be responsive to said misalignment error to operate said gimbal mechanism so as to correct alignment of the viewing direction of said target-tracking imaging sensor with the target.

7. A method for automatically acquiring a target by using a system with a target-detection subsystem including at least one target-detection imaging sensor having a first field-of-view and a target-tracking subsystem including an imaging sensor having a second field-of-view significantly smaller than said first field-of-view, the method comprising:

(a) employing the target-detection subsystem to detect a target;

(b) determining from said target-detection subsystem a target direction vector;

(c) operating a gimbal mechanism of the target-tracking subsystem so as to align a viewing direction of the target-tracking imaging sensor with the target direction vector;

(d) deriving an image from said target-tracking imaging sensor;

(e) correlating said image with at least part of an image from said target-detection subsystem by correlating features of said images to achieve image registration, thereby deriving a misalignment error, said correlating being based at least in part on background features not corresponding to the target; and (f) supplying said misalignment error to the target-tracking subsystem for use in acquisition of the target.

8. The method of claim 7, further comprising operating a missile countermeasure subsystem associated with the target-tracking subsystem.

9. The method of claim 7, wherein the target-detection subsystem includes a plurality of said target-detection imaging sensors deployed in fixed relation to provide an effective field-of-view significantly greater than said first field of view.

10. The method of claim 7, wherein corresponding regions of said images from said target-tracking imaging sensor and from said target-detection imaging sensor have angular pixel resolutions differing by a factor of at least 2:1.

11. The method of claim 7, wherein said correlating is performed using an image sampled from the target-detection imaging sensor at a time substantially contemporaneous with sampling of said image from the target-tracking imaging sensor.

12. The method of claim 7, further comprising correcting alignment of the viewing direction of said target-tracking imaging sensor as a function of said misalignment error.

* * * * *